US006126315A

United States Patent [19]

Ichikawa et al.

[11] Patent Number: 6,126,315

[45] **Date of Patent: *Oct. 3, 2000**

[54] CONTAINER FORMED OF LAMINATION SHEET

[75] Inventors: Toru Ichikawa; Taiki Ishikawa; Raizo Kuge; Norikazu Shigeta, all of Tokyo, Japan

[73] Assignees: Kabushiki Kaisha Hosokawa Yoko; Mitsubishi Corporation, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/121,671

[22] Filed: Jul. 23, 1998

[30] Foreign Application Priority Data

Jul. 23, 1997 [JP] Japan ..... 9-212522

[51] Int. Cl.[7] ..... B65D 30/18; B65D 33/38

[52] U.S. Cl. ..... 383/43; 383/104; 383/120; 383/121; 383/906

[58] Field of Search ..... 383/104, 120, 383/906, 202, 121, 122, 43; 222/107

[56] References Cited

U.S. PATENT DOCUMENTS

| | | | |
|---|---|---|---|
| 3,003,681 | 10/1961 | Orsini | 383/121 |
| 3,739,977 | 6/1973 | Shapiro et al. | 383/104 |
| 4,041,851 | 8/1977 | Jentsch | 383/122 |
| 4,454,979 | 6/1984 | Ikeda et al. | 383/104 |
| 5,273,362 | 12/1993 | Buchanan | 383/104 |
| 5,378,065 | 1/1995 | Tobolka | 383/104 |
| 5,411,203 | 5/1995 | Bochet et al. | 383/104 |
| 5,547,284 | 8/1996 | Imer | 383/104 |
| 5,788,121 | 8/1998 | Sasaki et al. | 383/906 |

FOREIGN PATENT DOCUMENTS

| | | | |
|---|---|---|---|
| 2 229 623 | 5/1973 | France | B65D 31/10 |
| 2 672 033 | 1/1991 | France | B65D 30/20 |
| 2671052 | 7/1992 | France | 383/122 |
| 0139383 | 5/1990 | Japan | 383/904 |
| 6255657 | 9/1994 | Japan | 383/104 |
| 823855 | 11/1959 | United Kingdom | 383/122 |
| 1010094 | 11/1965 | United Kingdom | 383/121 |
| 1092336 | 11/1967 | United Kingdom | 383/121 |
| WO 98/13272 | 4/1998 | WIPO | B65D 30/20 |

*Primary Examiner*—Stephen P. Garbe
*Attorney, Agent, or Firm*—Sughrue, Mion, Zinn, Macpeak & Seas, PLLC

[57] ABSTRACT

A liquid container having a stable shape that is easy to fill and that enables the user to pour out liquid to the last drop into an intended target using one hand only and without spilling the liquid. An internal space of a container is defined by a front surface portion, a rear surface portion having the shape identical with the front surface portion, and a pair of gussets each connecting together each confronting edges of the front and rear surface portions. The gusset has a folded arrangement. If liquid is filled in the container, V-shape of the gusset expands to provide a three dimensional container. The gussets extend to a neck portion. By the expansion of the gussets, a spout has a sufficient open area capable of controlled pouring of the liquid therethrough. If the liquid amount in the container is reduced, the spout is automatically closed when the container is self-standing on a table.

3 Claims, 9 Drawing Sheets

CONTAINER FORMED OF LAMINATION SHEET

BACKGROUND OF THE INVENTION

1. Field of the Invention

The present invention relates to a container for containing a liquid, the container being made of a flexible plastic lamination sheet.

2. Description of the Related Art

In recent years, there has been a movement to reduce consumption of natural resources. Also, it has become increasingly difficult to properly dispose of ever increasing amounts of garbage and refuse. Taking these circumstances into consideration, liquid containers formed from a thin plastic film have become increasingly popular. Liquid containers contain liquid such as liquid detergent, and are used to refill thick plastic bottles with the liquid. By using liquid containers, then the empty thick plastic bottles need not to be disposed of so that natural resources are preserved and amounts of refuse are reduced.

As shown in FIG. 15, a conventional liquid container 101 is a flat pouch formed by overlapping two substantially rectangular sheets of flexible plastic film and fusing together opposing edge portions of the film sheets. Liquid detergent L or some other liquid is sealed in the liquid container 101 via an upper seal fused portion 109*a,* which forms the spout of the pouch, a lower fused portion 109*b*, which forms a bottom portion 103 of the pouch, and side fused portions 109*c*. The sealed region of the upper fused portion 109*a* is thinner at its central portion so that when an empty plastic bottle is to be refilled with liquid L, the upper fused portion 109*a* is cut along the broken line 110 shown in FIG. 15 to open up a spout 102 near the central portion of the upper fused portion 109*a*. Liquid L can then be poured through the spout 102 into the empty plastic bottle (not shown in the drawings) in order to refill the empty plastic bottle.

When the conventional liquid container 101 is filled with liquid L, the two plastic film sheets forming the liquid container 101 separate from each other to form a container shape for holding the liquid, However, the container shape of the liquid container 101 is unstable to that the liquid container 101 must be held with both hands in order to accurately pour all of the liquid into the plastic bottle without spilling. Also, the spout 102 is substantially two dimensional. Because of this and because the two sheets of plastic film tend to move toward each other, it is very likely that the spout 102 will not open up sufficiently and that the sheets of plastic film will cling to each other at the spout 102. When the spout 102 does not sufficiently open up, liquid can creep between the sheets of plastic film toward the spout 102 by force of capillary action. As a result, liquid can flow out from unexpected and undesired positions of the spout 102. Further, because the liquid clings to and is supported between the two sheets of film, the liquid in the liquid container 101 can not be totally poured out to the last drop when refilling the plastic bottle.

It is difficult to fill the flat pouch shaped container with liquid at the factory, for example, unless gas has been completely removed from the container. This is especially the case when the container is to be filled with a liquid detergent. When the gas is incompletely removed from the container, air can mix with the liquid detergent while the liquid detergent is being introduced into the container. The air mixing with the liquid detergent can froth up into bubbles that take up space in the container. As a result, it is difficult to fill the container with a desired amount of liquid detergent.

In another aspect, a bottle or a container formed of a lamination sheet is conventionally used for containing therein a sticky food such as a mayonnaise. Such bottle has an upper portion provided with a cap and is deformable for squeezing the content out of the bottle. The lamination bottle is formed by blow molding technique and has three layers including polyethylene (PE), a copolymer of ethylene and vinyl alcohol (EVOH), and polyethylene (PE). The cap and the EVOH layer can provide oxygen blocking function so as to obviate oxidation of the content.

However, in case of the lamination bottle, air may be entered into the bottle by an amount corresponding to a consumption amount of the content. In order to eject air in the bottle, the bottle must be pressedly deformed against the restoration force of the bottle, while attention is drawn to the accidental discharge of the content through the pouring portion during the air discharge work, and then the cap must be placed on the pouring portion and then is fastened. Further, since the bottle is formed by the blow molding, a relatively large thickness of the EVOH layer is required in order to distribute the EVOH material over an entire area of the bottle. This causes increase in production cost, and further, the produced bottle is bulky. Accordingly, the lamination bottle is costly and requires relatively increased labor in production, transportation, and retention of the content within the bottle.

SUMMARY OF THE INVENTION

It is an object of the present invention to overcome the above-described problems and to provide a liquid container having a stable shape that is easy to fill and that enables the user to pour out liquid to the last drop into another bottle or onto an intended dish using one hand only and without spilling the liquid.

Another object of the invention is to provide a container capable of self-discharging air in the container without application of external force to the container, and providing a predetermined sealing function without a cap.

Still another object of the invention is to provide a light weight and compact table container which can be produced easily at low cost and transported easily.

These and other object of the present invention will be attained by a container formed from resin sheet for holding a liquid content to be poured, the container including an upper spout portion opened up by being cut, a bottom portion, and a body extending between the bottom portion and the upper spout portion. The body is adapted for containing the liquid content between the upper spout portion and the bottom portion. The body includes a front surface portion, a rear surface portion having the same shape as the front surface portion, and a pair of foldable gussets forming sides fused between confronting edges of the front and rear surface portions. Each gusset has a substantially V shape in cross-section. The front surface portion and the rear surface portion have a narrower width at their upper portions than at other portions, thereby forming at the upper portions a neck extending to the spout portion. A part of each gusset serves as each side of the neck, and deformation of the gussets enables the upper portion of the front surface portion and the upper portion of the rear surface portion to move away from each other during pouring operation.

The gussets are preferably formed from a material with greater flexibility than the front and rear surface portions.

A liquid holding portion is provided in the body except the neck, and the liquid holding portion has a square cross-section when each gusset is deformed from its V-shape to a linear shape as a result of filling the liquid content in the liquid holding portion. Preferably, the liquid holding portion has a height ranging from 1.1 to 3 times as long as one side of the square whereby the container can maintain its self-upstanding posture. Further, a first distance between the front surface portion and the rear surface portion at the liquid holding portion is from 10 to 14 times as long as a second distance between the front surface portion and the rear surface portion at the neck when the liquid content is retained in the liquid holding portion, whereby an acute top angle is provided at a top edge of the spout in the self-upstanding posture.

BRIEF DESCRIPTION OF THE DRAWINGS

The above and other objects, features and advantages of the invention will become more apparent from reading the following description of the preferred embodiment taken in connection with the accompanying drawings in which:

FIG. 7(*b*) is a cross-sectional view showing the first modification of the spout of FIG. 7(*a*);

DETAILED DESCRIPTION OF THE PREFERRED EMBODIMENT

Figure 1:
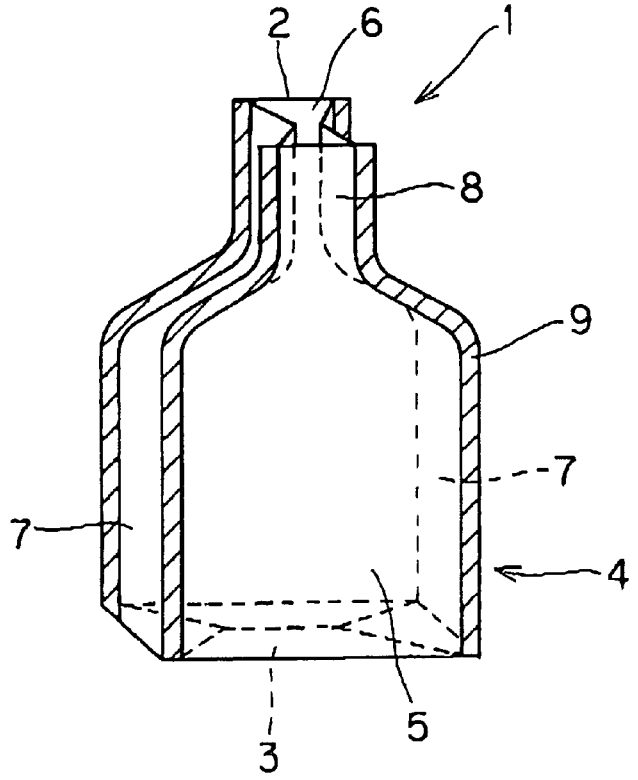
FIG. 1 is a perspective view showing a liquid container according to a first embodiment of the present invention in a condition directly before liquid contents of the container is poured into a bottle to be refilled.

A liquid container 1 according to a first embodiment of the present invention will be described while referring to FIGS. 1 to 6. The first embodiment pertains to a liquid refill container 1 for filling a bottle (not shown) with a liquid, such as a liquid detergent, when the bottle needs to be refilled with the liquid. The liquid container 1 includes a spout 2, a bottom 3, and a body 4. The liquid is held in the body 4 between the spout 2 and the bottom 3. The body 4 includes a front surface portion 5, a rear surface portion 6 having the same shape as the front surface portion 5, and a pair of gussets 7,7.

The gussets 7,7 connect the front surface portion 5 and the rear surface portion 6 together and are foldable inward so as to have a substantial V shape in cross-section. The gussets 7,7 are fused to the front surface portion 5 and the rear surface portion 6 by, for example, heat sealing. That is to say, one edge of each gusset 7,7 is heat sealed to one of the left and right edges of the front surface portion 5 and the other edge of each gusset 7,7 is heat sealed to one of the left and right edges of the rear surface portion 6, thereby forming a seal portion 9 having a width of about 6 mm.

Figure 2:
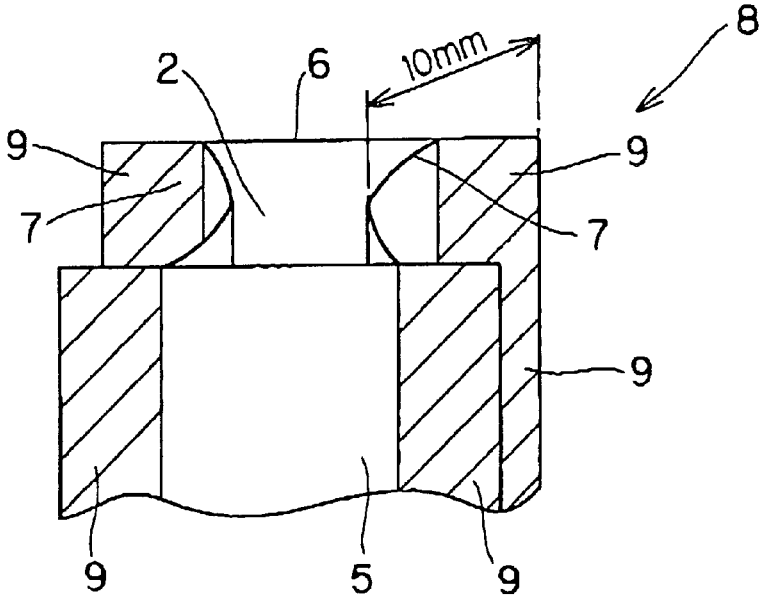
FIG. 2 is an enlarged perspective view showing a neck and spout of the liquid container of FIG. 1.

The front and rear surfaces portions 5, 6 are narrowest at their upper ends, thereby forming a neck 8, which leads to the spout 2. The neck 8 has a shape similar to the shape of the neck of a bottle. The gussets 7,7 are also connected to the front and rear surface portions 5, 6 at the neck 8. Here, example dimensions for the liquid container 1 will be described. When the entire liquid container 1 is 210 mm high, then as shown in FIG. 2, the bending width of the gussets 7,7 at the neck 8 is set to 10 mm, the sealed portions at the neck 8 have a width of about 6 mm, and the gussets 7,7 at the neck 8 have a freely movable and deformable folding width of 4 mm at the neck 8.

The body 4 is formed from a flexible plastic material. For example, when the liquid container 1 has a capacity of 500 ml, then the body 4 can be formed from three layered laminate film. The three layered laminate film in this example includes a 12 micron thick biaxially oriented polyester film, a 15 micron thick biaxially oriented nylon film, and an 80 to 120 micron thick linear low density polyethylene (LDPE) film. On the other hand, when the liquid container has a capacity of 250 ml, the body 4 is formed from a two layered laminate film including a 15 micron thick biaxially oriented nylon film and an 80 to 120 micron thick linear low density polyethylene film.

It is desirable that the gussets 7,7 be formed from a more flexible material than the front and rear surface portions 5, 6. The linear low density polyethylene film used for forming the above-described laminate film is an example of material suitable for forming the gussets 7,7. However, in this case the linear low density polyethylene film should have a thickness about 20 microns thinner when used to form the gussets 7,7 than when used to form the front and rear surface portions 5, 6.

Figure 3:
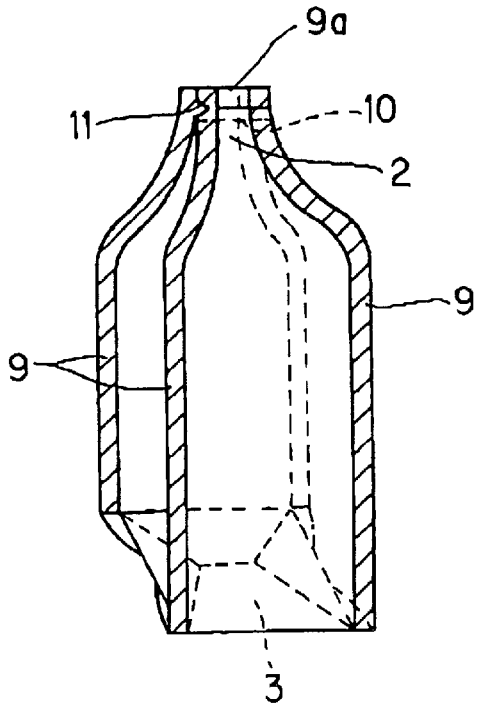
FIG. 3 is a perspective view showing the liquid container according to the first embodiment in a condition after the liquid container has been filled with a desired liquid before shipping.

FIG. 3 shows the liquid container 1 after it has been filled with a desired liquid at the factory and is ready for shipment. An upper seal portion 9*a* is formed for covering the spout 2. A straight cutting line 10 is printed, for example, below the-upper seal portion 9*a*. The straight cutting line 10 serves as a gauge when the liquid container 1 is to be opened. A notch 11 for facilitating opening of the liquid container 1 can be formed as needed in the heat seal portion 9.

Figure 4:
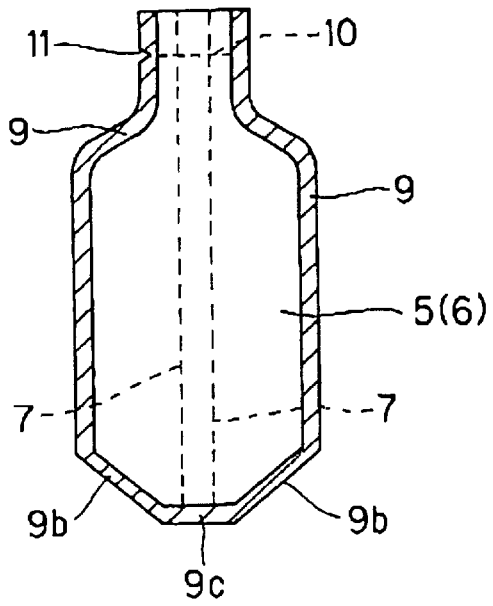
FIG. 4 is a plan view showing the liquid container according to the first embodiment before the liquid container is filled with liquid.

FIG. 4 shows the shape of the liquid container 1 before it has been filled with liquid. The lower edges of the front and rear surface portions 5, 6 and the gussets 7,7 include a pair of symmetrical slanting edges 9*b*, 9*b*. and a central edge 9*c* in order to fashion the bottom 3 into the shape shown in FIG. 1.

Figure 5:
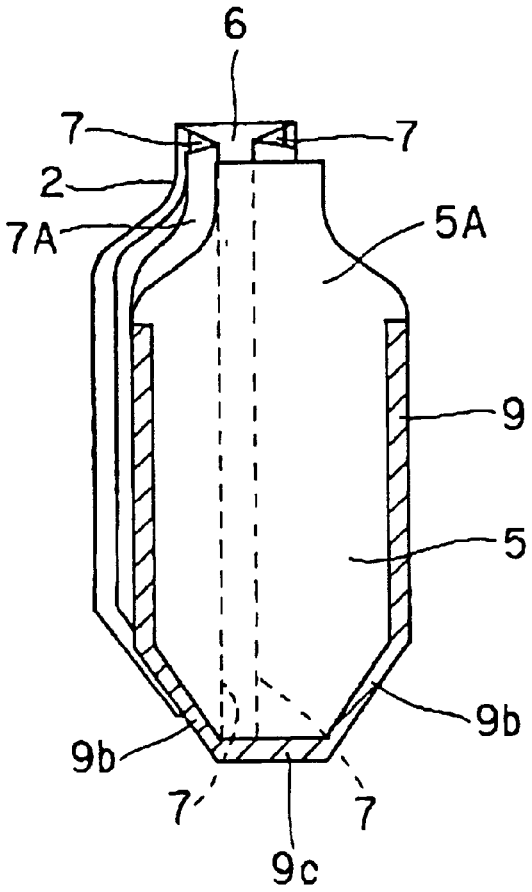
FIG. 5 is a perspective view showing the liquid container according to the first embodiment before the liquid container is filled with liquid.

When the liquid container 1 is to be filled with a liquid detergent, the liquid detergent must be smoothly introduced into the container 1, otherwise great amounts of bubbles can be formed in the liquid detergent. As shown in FIG. 5, which is a perspective view showing the liquid container 1 directly before it is filled with liquid, an upper edge portion 5A near the neck 8 of the front surface portion 5 is not fused with the upper edge portion 7A of the gussets 7,7. This forms a broad opening through which the liquid detergent can be introduced. As a result, air within the liquid container 1 can easily escape when the liquid detergent is introduced into the container 1. Therefore, the liquid detergent can be smoothly introduced into the liquid container 1. Also, because the opening is broad, a nozzle having a relatively large diameter can be used to fill the liquid container 1 with liquid detergent so that filling operations can be performed more smoothly, easily, and quickly. After the liquid container 1 has been filled with the liquid detergent, then the front surface portion 5 and the gussets 7,7 are heat sealed together at the side and top upper edges.

When the liquid container 1 is filled up with liquid, the gussets 7,7 will unfold so that the liquid container 1 develops a stable three dimensional shape. When a bottle (not shown) is to be refilled with liquid, then the upper seal portion 9*a* is removed by cutting along the cut line 10 in order to open up the spout 2. Because the liquid container 1 has excellent stability of shape, the user can hold the liquid container 1 in one hand without the liquid container 1 folding at its center. As a result, the liquid container 1 maintains its three dimensional shape while the liquid is poured from the spout 2 into the bottle.

Because the gussets 7,7 are provided at the neck 8 as well as at other portions along the front and rear surface portions 5, 6, the front and rear surface portions 5, 6 will properly separate from each other at the spout 2 when the gussets 7.7 fold open. As a result, the spout 2 will open more easily so that undesirable problems caused by capillary action will not occur. Also, because the gussets 7,7 are formed from a flexible material, the gussets 7.7 can easily be unfolded into a wide open V shape. By forming the gussets 7,7 from a material that is more flexible than the material for forming the front and rear surfaces 5, 6, the gussets 7,7 can be even more easily unfolded into a wide open V shape so that the opening degree of the spout 2 can be further improved.

Figure 6:
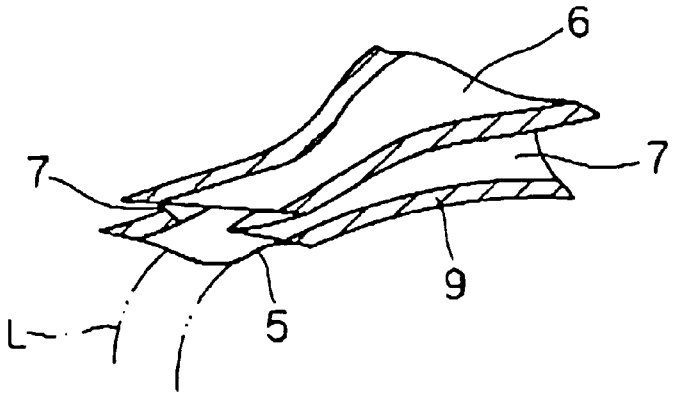
FIG. 6 is a partial perspective view showing the neck and spout of the liquid container according to the first embodiment while liquid is being poured from the spout into the bottle to be filled.

Because the gussets 7,7 serve to separate the front and rear surface portions 5, 6 from each other, when the liquid L is poured out of the container 1 to refill a bottle or to pour the liquid into a dish, then the weight of the liquid L bends the lower facing one,-of the upper and lower surface portions 5, 6 into the a curved shape as shown in FIG. 6. This curved shape enables the user to direct the liquid L accurately toward a desired position of the opening of the bottle to be filled so that spilling can be avoided. That is to say, the stable shape of the liquid container itself and the desirable manner in which the spout opens cooperate together to enable a user to easily refill an empty bottle even when holding the liquid container 1 with only one hand.

It was described above that the liquid container was used for holding liquid detergent. However, because the first embodiment enables a user to easily pour out desired amounts, the liquid container according to the first embodiment can be used as a tabletop vessel for storing sauce, ketchup, and other liquid materials.

Figure 7:
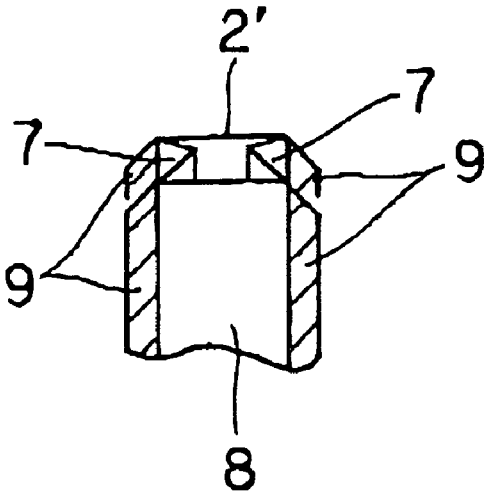
FIG. 7(*a*) is a partial perspective view showing a first modification to the first embodiment with respect to the spout of the liquid container.
Figure 7:
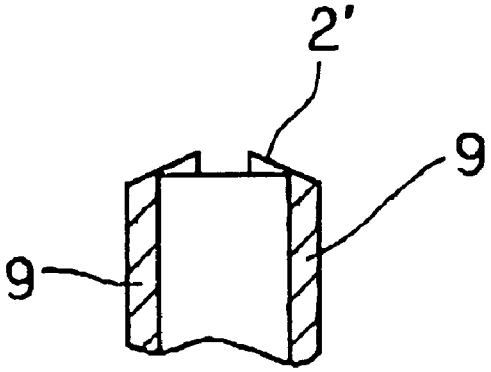

Further, although the first embodiment described the cutting line 10 as a straight line for indicating to a user to cut horizontally across the neck 8 to open the spout 2, two diagonally extending cutting lines can be provided symmetrically on left and right sides of the seal portion of the neck. FIGS. 7(*a*) and 7(*b*) show a spout 2' formed by cutting two such diagonally extending cutting lines. As shown, the spout 2' has a protruding shape so that it is easier to aim at the opening of the bottle to be filled.

Also, the configuration shown in FIG. 5 provides a large opening into which liquid can be introduced. In the above-described example, to provide the large opening, the upper edge 5A of the front surface portion 5 was described as being separated from the upper edge portion 7A of the gussets 7,7 until after liquid is introduced to fill up the liquid container 1. However instead, the upper edge of the rear surface portion 6 can be left separated from the upper edge of the gussets 7,7 at the spout 2 until after liquid is introduced to fill up the liquid container 1.

Figure 8:
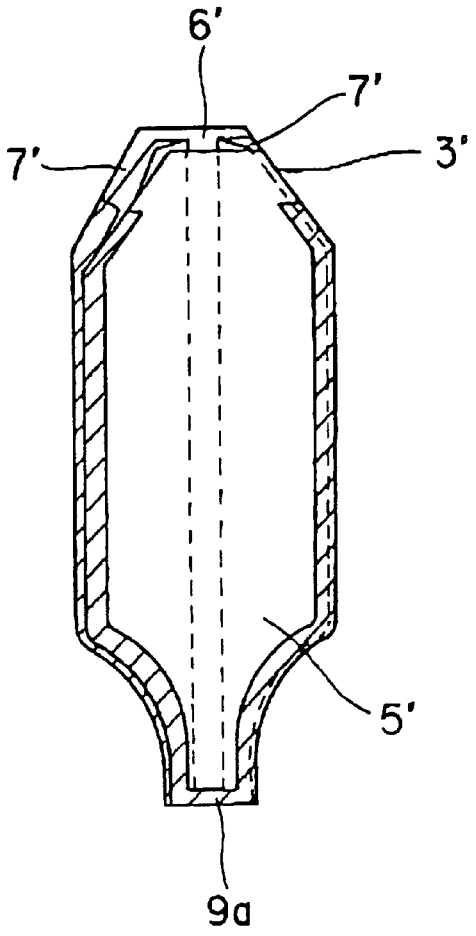
FIG. 8 is a perspective view showing a second modification to the first embodiment before being filled with liquid.

Further, as shown in FIG. 8, the neck of the liquid container and the upper edge can be presealed and the front and rear surface portions 5', 6' can be left separated from the gussets 7',7' at the bottom 3'. In this case, when the container is to be filled with liquid, it is turned upside down and filled with liquid through the resultant bottom opening. After the liquid container is filled up, the bottom unsealed portion is heat sealed closed.

Figure 9:
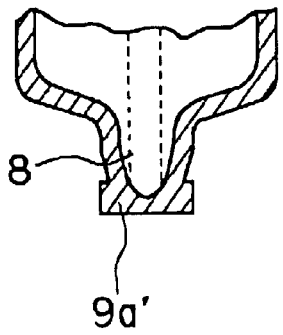
FIG. 9 is a partial cross-sectional view showing a neck that can be applied to the second modification of FIG. 8.
Figure 10:
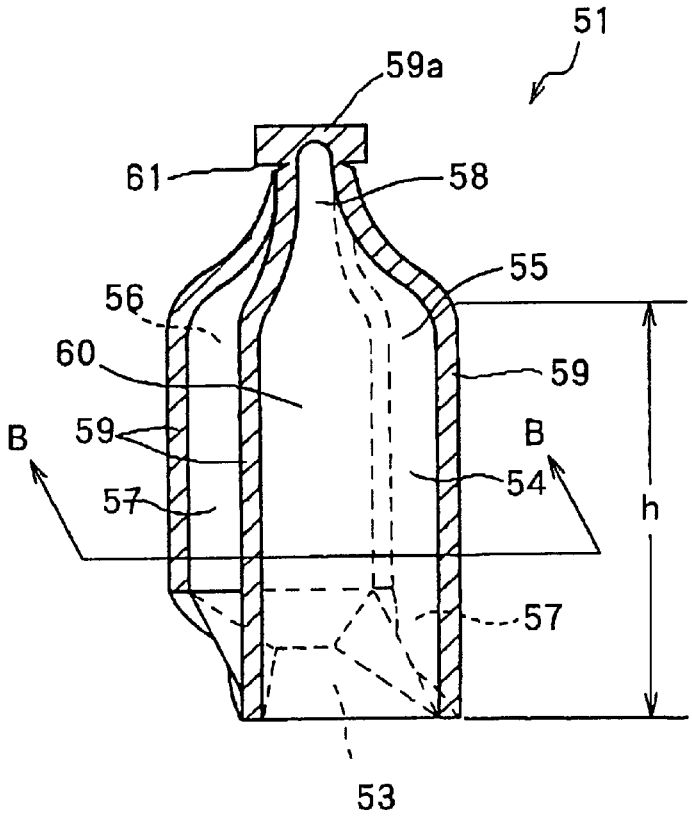
FIG. 10 is a perspective view showing a liquid container according to a second embodiment of the present invention in a state where the liquid is fully filled in the container.
Figure 11:
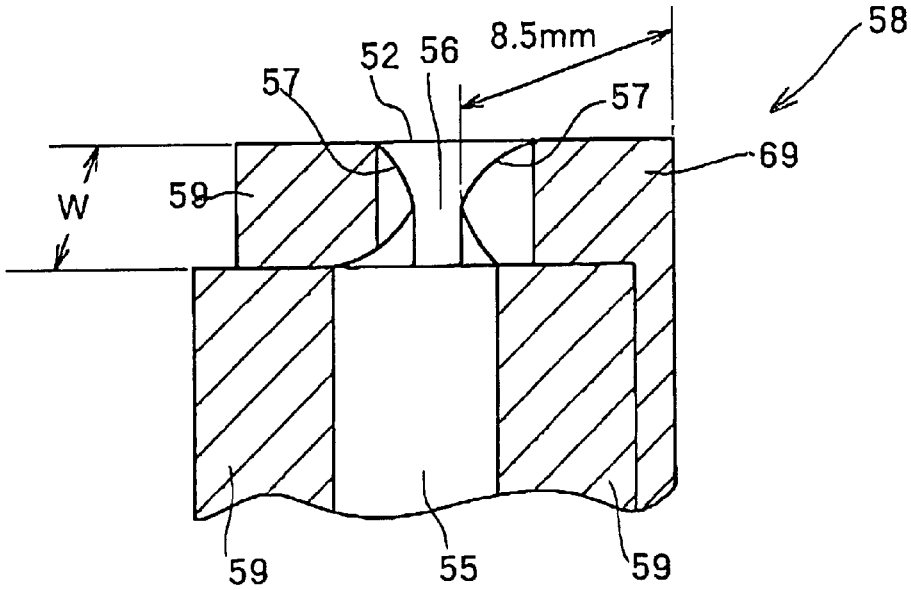
FIG. 11 is an enlarged perspective view showing a neck and spout of the liquid container of FIG. 10.

Compared to the method described with respect to FIG. 5 wherein the neck portion is heat sealed after the container has been filled with liquid, the method described with respect to FIG. 8 is beneficial if the heat seal portion 9*a*' near the neck 8 has a complicated design as shown in FIG. 9. In any event, a nozzle having a large diameter can be used in this case also to fill the liquid container so that liquid can be easily and efficiently introduced into the liquid container.

According to the liquid container of the first embodiment, because the gussets are provided at the side walls of the liquid container, the gussets expand when the liquid is filled in the container, so that the container can maintain a stabilized three dimensional configuration to avoid accidental bending of the container. Therefore, the liquid pouring operation into a bottle can be performed easily even by one hand. Further, since the gussets are also provided at the neck portion, the spout at the tip of the neck can be easily opened up so that liquid can be easily and reliably poured into the bottle.

Further, because the gussets are formed from flexible material, the gussets easily deform so that the front and rear surface portions can easily separate at the neck portion for further ensuring liquid pouring efficiency into a bottle.

Further, when a portion of the neck is left unfused, a large spout can be obtained so that gas can easily escape from the liquid container when filling up the liquid container. Therefore, filling operations of the liquid container can be more easily and efficiently performed.

Further, when a portion of the bottom is left unfused, a large filling opening can be obtained so that gas can easily escape from the liquid container when filling up the liquid container. Therefore, filling operations of the liquid container can be more easily and efficiently performed.

Further, since the front and rear surface portions are heat-sealed to the gussets in producing the container, resultant container can be easily produced at a low cost in comparison with the blow molding technique.

Further, since the side walls of the container are formed by the V-folded gussets, the container can provide two dimensional shape prior to filling a content into the container. Accordingly, the container can have a compact size which is advantageous in transportation.

A container 51 according to a second embodiment will next be described with reference to FIGS. 10 through 14. In addition to the above-described features of the first embodiment, the second embodiment provides further advantage in terms of retainability or sealability of a material in the container after removal of the top heat seal portion (9*a* in FIG. 3) and without any cap for the opening.

Similar to the first embodiment, the container 51 includes a spout 52, a bottom 53, and a body 54. The liquid is held in the body 54 between the spout 52 and the bottom 53. The body 54 includes a front surface portion 55, a rear surface portion 56 having the same shape as the front surface portion 55, and a pair of gussets 57,57. The gussets 57,57 connect the front surface portion 55 and the rear surface portion 56 together and are foldable inward so as to have a substantial V shape in cross-section. The gussets 57,57 are fused to the front surface portion 55 and the rear surface portion 56 by, for example, heat sealing. That is to say, one edge of each gusset 57,57 is heat sealed to one of the left and right edges of the front surface portion 55 and the other edge of each gusset 57,57 is heat sealed to one of the left and right edges of the rear surface portion 56, thereby forming a seal portion 59 having a width of about 6 mm. The width of the heat seal portion 59 is relatively large, so that the heat seal portion 59 can serve as a shape holding member or a shape supporting member for maintaining a three dimensional shape of the container 51 to provide a shape stability even if the container 51 is formed of a relatively thin material.

The front and rear surfaces portions 55, 56 are narrowest at their upper ends, thereby forming a neck 58, which leads to the spout 52. The neck 58 has a shape similar to the shape of the neck of a bottle. The heat seal portion 59*a* at the upper end of the neck 59 is formed with a notch 61, so that the uppermost heat seal portion 59*a* can be removed along the notch to provide the open spout 52 shown in FIG. 11.

A width of the upper front surf ace portion 55 and the upper rear surface portion 56 which constitute the neck 58 is 18 mm. The width contains a width of the right and left heat seal portions 59, 59 each having a width of 6 mm. Therefore, an effective width of the spout is 6 mm. Further, each gusset 57 between the front and rear surface portions 55 and 56 also serves as a side wall of the neck 58. Each V-folded width of the gusset 57 is 8.5 mm. Because the heat seal portion 59 has a width of 6 mm, a freely movable or deformable length of the V-folded width of each gusset 57 is 2.5 mm. In the body 54, the front and rear surface portions 55 and 56 except the neck area 58, and gussets 57,57 connecting the front and rear surface portions together define therein a liquid holding portion 60. The front and rear surface portions 55, 56 for the liquid holding portion 60 has a width of 75 mm. Because each side heat seal portion 59, 59 has a width of 6 mm, the liquid holding space has an effective width of 63 mm. Further, the V-folded gusset for the liquid holding portion 60 has a width of 36 mm. Therefore, the effective width of the V-folded gusset 57 for the liquid holding portion is 30 mm. Accordingly, a cross-sectional area, taken along the line B—B in FIG. 10, of the liquid holding portion 60 is generally square shape (63 mm×60 mm) Because the container 51 is of a table top use, it is preferable that the liquid holding portion 60 has a size capable of holding the container by a single hand.

Figure 12:
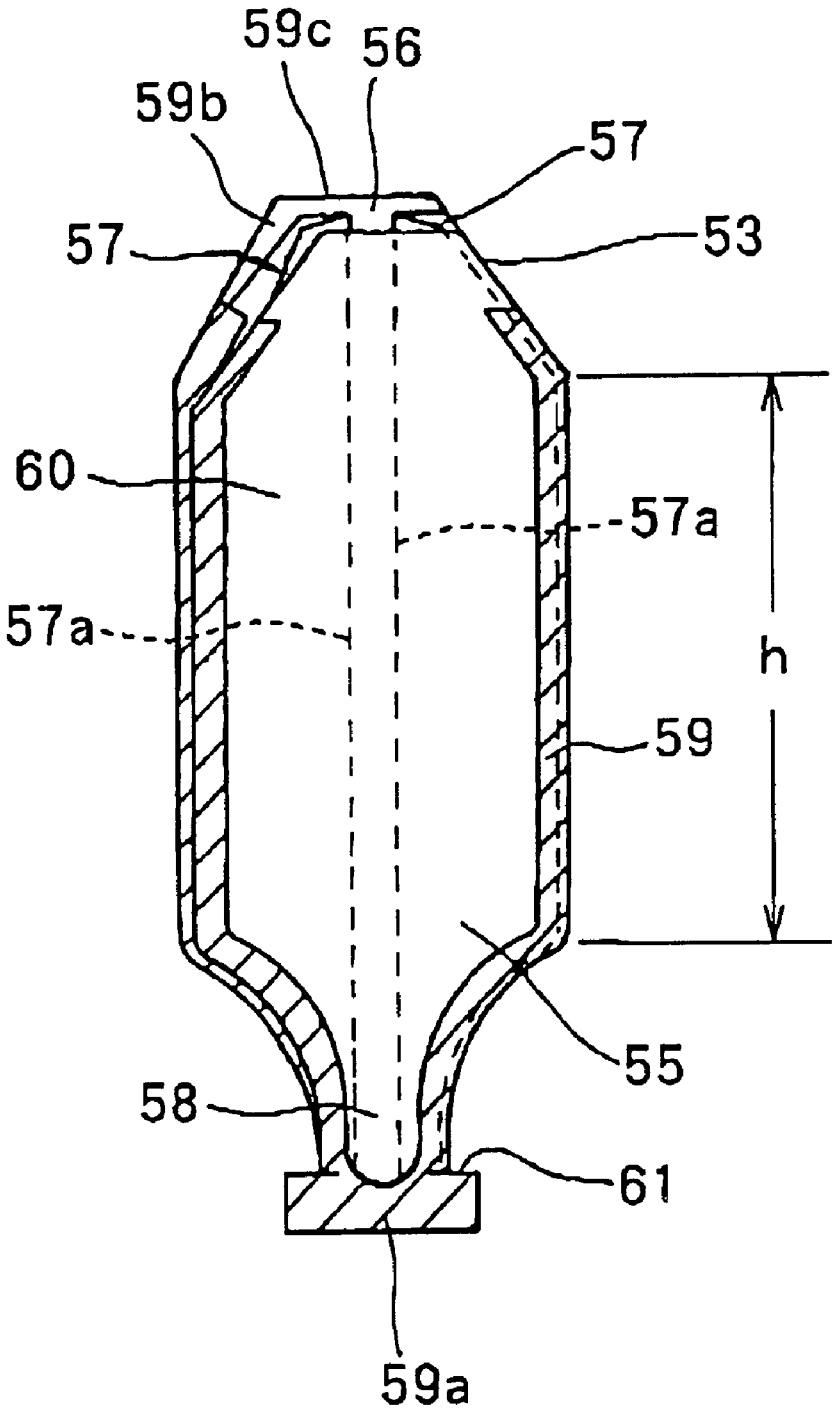
FIG. 12 is a perspective view showing the liquid container according to the second embodiment before the liquid container is filled with a desired liquid.

In order to provide the bottom portion 53, as shown in FIG. 12, each lower edge of the front and rear surface portions 55, 56 and each lower edge of the gusset 57 include a pair of symmetrically slant edges 59*b*, 59*b* and a central edge 59*c*. A height "h" of the liquid holding portion 60 is in a range of from 80 to 180 mm, and preferably 105 mm.

The front and rear surface portions 55 and 56 are formed from a flexible plastic material. As a first example, each surface portion 55, 56 includes a 12 micron thick biaxially oriented polyester film, a 15 micron thick biaxially oriented nylon film, and an 120 micron thick linear low density polyethylene film The gussets 57,57 are formed from a more flexible material than the front and rear surface portions 55, 56. For example, is available a two layered laminate film including a 15 micron thick biaxially oriented nylon film and an 120 micron thick linear low density polyethylene film.

The biaxially oriented polyester film has a sufficient heat resistance, and provides sufficient shape retainability suitable for obtaining dimensional stability during production step of the container. Further, this material is advantageous in the manufacture during heat sealing. The biaxially oriented nylon film provides sufficient strength, so that this material can withstand a load during transportation and handling of the container without increasing its size or thickness. The linear low density polyethylene film has a sufficient heat adhesive characteristic suitable for manufacture of the container 1. Further, this material has a given strength, even though the strength is lower than that of the biaxially oriented nylon film. If slip additive is not added in the production of the linear low density polyethylene film, the resultant container is available for a milk or milky material container.

As a second example of the material of the front and rear surface portions 55 and 56, a four layered film is available for improving gas shielding function which includes a 12 microns thick biaxially oriented polyester film, a 9 micron thick aluminum foil, a 15 micron thick biaxially oriented nylon film, and 100 micron thick linear low density polyethylene film. In this case, the gusset 57 is formed of a four layered film including 12 microns thick biaxially oriented polyester film, a 9 micron thick aluminum foil, a 15 micron thick biaxially oriented nylon film, and 70 micron thick linear low density polyethylene film. With this arrangement, the aluminum foil can block moisture, oxygen and light to improve a barrier function.

Because, the container 51 is made of the lamination film which facilitates production of the container by the heat-sealing process, entire production cost can be lowered in comparison with a lamination bottle produced by blow molding.

As a third example of the material of the front and rear surface portions 55, 56, is available a three layered film including a 12 micron thick biaxially oriented polyester film, a 12 micron thick biaxially oriented polyester film deposited with silicon oxide (transparent evaporation film), and a 120 micron thick linear low density polyethylene film. In this case, the gusset 57 is a three layered film including a 12 micron thick biaxially oriented polyester film, a 12 micron thick biaxially oriented polyester film deposited with silicon oxide (transparent evaporation film). and a 80 micron thick linear low density polyethylene film. With this arrangement, the transparent evaporation film serves as a barrier layer. Instead of the linear low density polyethylene layer, a 120 micron thick non-oriented polypropylene can be used for the front and rear surface portions 55, 56. Further, instead of the linear low density polyethylene, a 80 micron thick non-oriented polypropylene can be used for the gusset 57. In this case, the container can be used for a retort pouch in which prepared food is hermetically sealed for long-term unrefrigerated storage. Further, such container can be set in a microwave open.

FIG. 12 shows a shape of the container 1 prior to filling of a liquid. The neck 56 and the upper edge portion are provisionally heat-sealed. However, the lower parts of front and rear surface portions 55, 56 and the gussets 57, 57 which constitute the bottom 53 of the container are unsealed similar to the state shown in FIG. 8. The liquid can be injected into the container through the bottom unsealed opening. After filing, the unsealed portions 59*b* and 59*c* are heat sealed to form the bottom 53. Incidentally, the reference numeral 57*a* designates a folding line of the gusset 57.

With this arrangement, if the liquid is fully filled in the container 51, the V-folded gussets 57, 57 are opened to provide a stabilized three dimensional shape. In this case, the bottom 57 has a generally square shape (63 mm×60 mm) the same as the cross-section taken along the line B—B in FIG. 10. Because the liquid holding portion 60 has a height "h" of 105 mm, the container 51 is self-standable with the above mentioned bottom area. Here, provided that the bottom area is A×A, the height "h" of the liquid holding portion 60 is a requisite factor. The height "h" must be in a range of 1.1A to 3A. If "h" is less than 1.1A, it would be rather difficult to hold the container with one hand. On the other hand, if "h" is not less than 3A, the container becomes unstable when putting on the table to degrade self-upstanding function.

Figure 14:
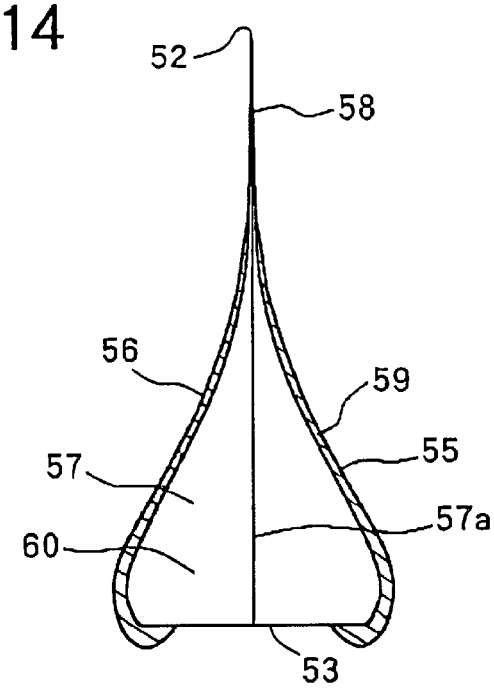
FIG. 14 is a side view showing the liquid container according to the second embodiment in a state where a part of the liquid remains in the container after pouring.
Figure 15:
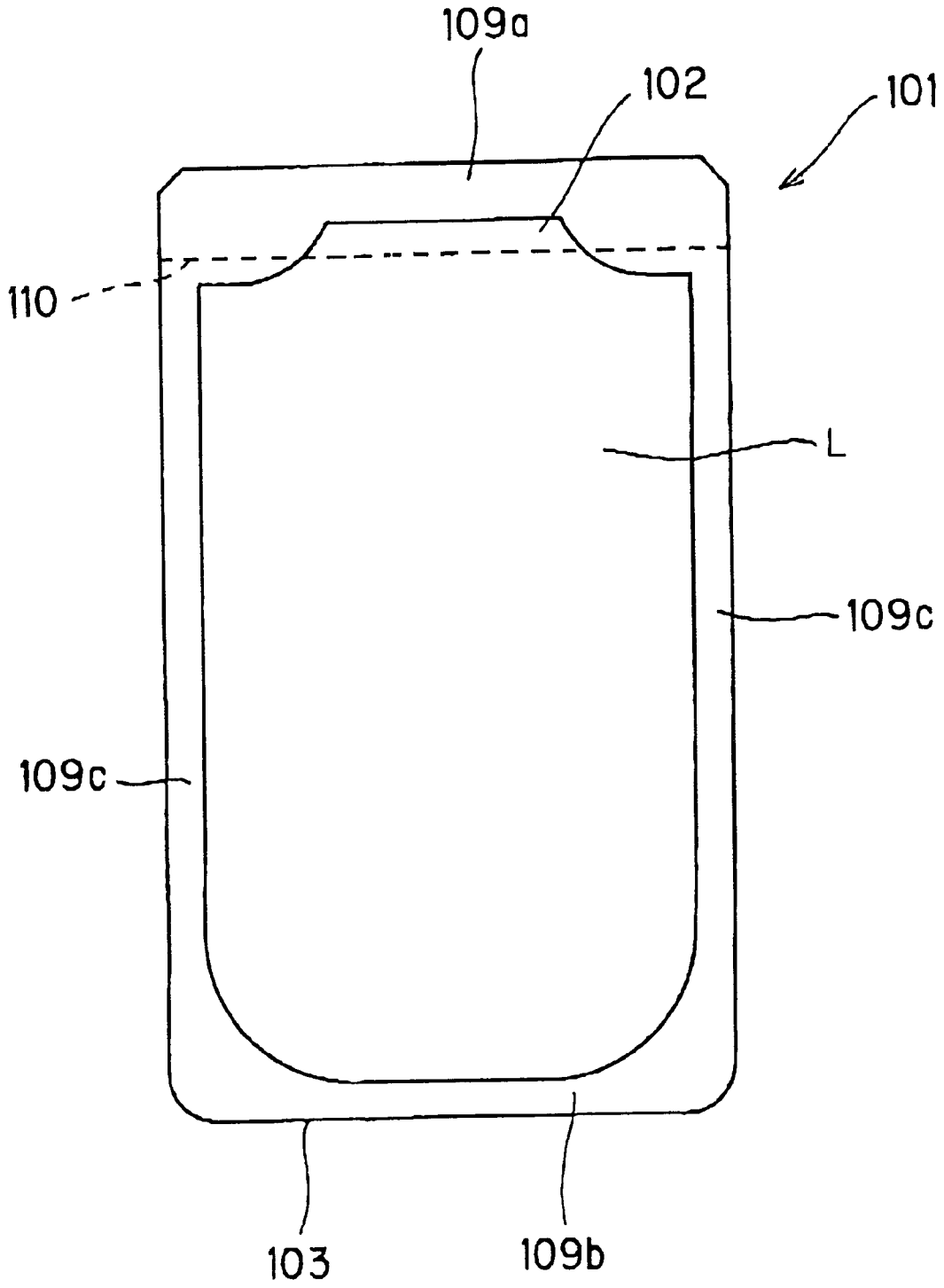
FIG. 15 is a plan view showing a conventional liquid container.

Further, by the self-upstanding function of the container 1, the liquid in the container can be directed toward the bottom 53 because of own weight of the liquid after a part of the liquid is discharged. Accordingly, at the liquid holding portion 60, the liquid pressure is applied to the gussets 57,57 in a direction opposite the restoration force of the gussets 57, 57, the restoration force being directed to the folding direction of the gussets. Thus, the gussets 57, 57 are pressed open by the liquid pressure. In this instance, since the each gusset 57 has a width of 60 mm at the side of the liquid holding portion 60, and has a width of 5 mm at the side of the neck 58, the side of the container 51 has an acute angle portion at the top edge of the neck 58 as shown in FIG. 14. Consequently, at the uppermost edge of the neck 58, a force is generated to move the front surface portion 55 and the rear surface portion 56 toward each other. Thus, the spout 52 can be automatically closed without application of external force to the spout 52.

Figure 13:
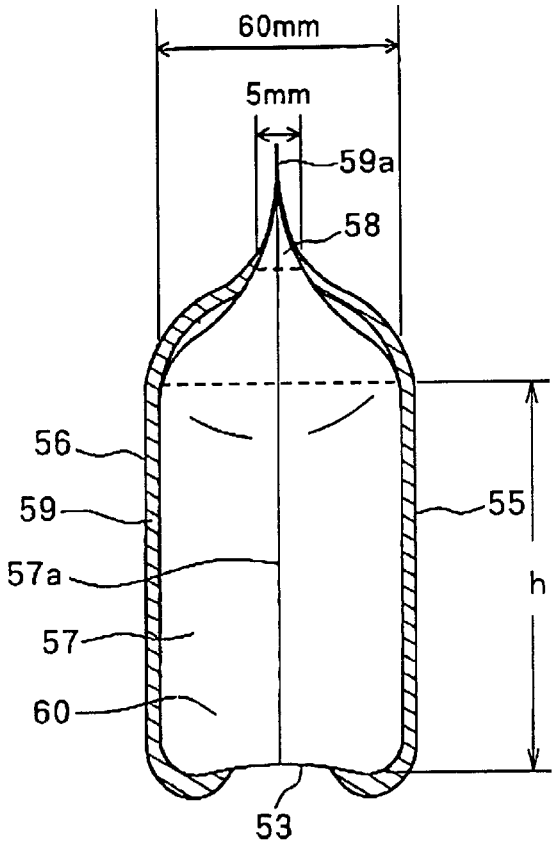
FIG. 13 is a side view showing the liquid container according to the second embodiment in a state where the liquid is fully filled in the container.

Referring to FIG. 13, a first distance between the front and rear surface portions 55 and 56 at the liquid holding portion 60 is from 10 to 14 times as long as a second distance between the front and rear surface portions 55 and 56 at the neck portion 58. If the first distance is shorter than 10 times of the second distance, the above described acute angle cannot be formed, so that self-closing function of the spout 52 cannot be realized. On the other hand, if the first distance is greater than 14 times of the second distance, a width "W" (FIG. 11) at the spout 52 is relatively small, so that the above-described self-closing function of the spout becomes excessive. As a result, it becomes difficult to pour the liquid in the container. FIG. 13 shows a case where the first distance is 12 times as long as the second distance.(That is, the distance at the neck is 5 mm whereas the distance at the liquid holding portion is 60 mm). According to experiments, a preferable size of the spout 52 is 5 mm×6 mm, if the cross-sectional area of the liquid holding portion 60 is 60 mm×63 mm for performing a desirable pouring.

Further, if a volume of the liquid in the container 51 is reduced in accordance with the consumption of the liquid, as shown in FIG. 14, the liquid is congregated at the bottom 53 due to its own weight. As a result, liquid pressure against the V-shape restoration force of the gussets 57, 57 is not any more applied to the upper portion of the liquid holding portion 60. Accordingly, the gussets 57, 57 will restore or recover their original V-folded shape to reduce a distance between the front and rear surface portions 55 and 56 of the upper part of the liquid holding portion 60. Accordingly, air or gas within the upper portion of the liquid holding portion can be automatically discharged outside through the spout 52.

Furthermore, when the container 51 is returned to its original upstanding posture after laying down the container 51 or turning the container upside down for pouring the liquid to an intended object, the liquid in the container is moved to the bottom 53 of the container 51, and at the same time, the spout 52 is rapidly closed in a manner described above. Therefore, entry of an external air into the container 51 can be avoided.

As described above, the container 51 can provide self-upstanding posture as shown in FIGS. 13 and 14 when the container 51 is simply placed on a table. Thus, the spout 52 can be automatically closed during its upstanding posture. Accordingly, accidental falling of the container 51 can be avoided to avoid spilt of large amount of liquid from the container 51. In order to surely avoid spilt of the liquid even by the falling of the container 51, the neck portion 58 can be folded along a line parallel with the open edge of the spout 52.

The second embodiment is particularly useful for a table-top container of sticky food such as ketchup and sauce. However, the second embodiment is also available for liquid detergent since an intended amount of liquid can be easily poured out. Further, the first and second embodiment is a proper substitute for a conventional glass bottle or PET bottle.

In view of the foregoing, in the container according to the second embodiment, the liquid holding portion except the neck portion has a square shape in cross-section when the gussets are deformed linearly upon filling a content into the container. Further, in this case, the height of the liquid holding portion is in a range of from 1.1A to 3A provided that the bottom area is A×A. Accordingly, the container can provide self-upstanding characteristic. Moreover, since a first distance between the front and rear surface portions at the liquid holding portion is 10 to 14 times as long as a second distance between the front and rear surface portions at the neck. Therefore, acute angled top corner can be provided at the side wall of the neck in a state where the liquid is filled in the container. Therefore, a force directing the front and rear surface portions to be moved toward each other is generated at a portion adjacent the spout. Consequently, the spout can be automatically closed during upstanding posture of the container. This automatically closing nature can be assisted by the inherent V-shape restoration force of the gussets. Thus, a given shielding function can be provided without a cap to the spout. During the self closing process, a part of the internal air in the container can be discharged outside because of the inward deformation of the front and rear surface portions.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A container comprising:

a spout;

a bottom; and a body extending between the bottom and the spout, the body including (1) a front wall, (2) a rear wall opposing the front wall, and (3) a pair of deformable gussets extending between confronting edges of the front wall and the rear wall, wherein the body includes a liquid holding portion and a neck extending from the liquid holding portion to the spout, and each gusset is substantially V-shaped in cross-section;

wherein, during a pouring operation in which a liquid content is poured from the container, the gussets are deformed under the influence of the liquid content, such that the front wall and the rear wall are forced apart from each other;

wherein the liquid holding portion has a square cross-section when the gusset are deformed from the V-shape to a linear shape as a result of the liquid content in the liquid holding portion;

wherein the liquid holding portion has a height ranging from substantially 1.1 to 3 times as long as one side of the square cross-section, such that the container maintains a self-upstanding posture;

wherein a distance between the front wall and the rear wall at the liquid holding portion is substantially 10 to 14 times as long as the distance between the front wall and the rear wall at the neck when the liquid content is retained in the liquid holding portion, thereby forming an acute top angle at a top edge of the spout in the self upstanding posture, such that after the pouring operation and after the container is positioned in an upstanding posture, the gussets elastically restore, without influence from an external force so that the front wall abuts the rear wall to automatically close the spout; and wherein the gussets are formed from a material with greater flexibility than the front and the rear walls.

2. A container as claimed in claim 1 in combination with the liquid content, wherein the liquid content is a liquid detergent, and an upper edge of at least one of the front and the rear walls at the neck is not fused with a corresponding edge of the gussets before the body is filled with the liquid detergent.

3. A container as claimed in claim 1 in combination with the liquid content, wherein the liquid content is a liquid detergent, and lower portions of the front and the rear walls are not fused with corresponding portions of the gussets before the body is filled with the liquid detergent.

* * * * *